US005118363A

United States Patent [19]

Chakrabarti et al.

[11] Patent Number: 5,118,363

[45] Date of Patent: Jun. 2, 1992

[54] PROCESSING FOR HIGH PERFORMANCE TI-6A1-4V FORGINGS

[75] Inventors: Amiya K. Chakrabarti, Monroeville, Pa.; George W. Kuhlman, Jr., Pepper Pike; Stanley R. Seagle, Warren, both of Ohio

[73] Assignee: Aluminum Company of America, Pittsburgh, Pa.

[21] Appl. No.: 440,634

[22] Filed: Nov. 24, 1989

Related U.S. Application Data

[62] Division of Ser. No. 203,691, Jun. 7, 1988. Pat. No. 4,898,624.

[51] Int. Cl.[5] ..... C22F 1/18

[52] U.S. Cl. ..... 148/671; 148/421; 148/670; 148/11.5 F; 148/12.7 B; 148/133

[58] Field of Search ..... 148/12.7 B, 11.5 F, 148/133, 11.5 R

[56] References Cited

U.S. PATENT DOCUMENTS

| | | | |
|---|---|---|---|
| 3,635,068 | 1/1972 | Warmough et al. | 148/11.5 F |
| 3,649,374 | 3/1972 | Chalk | 148/11.5 F |
| 3,963,525 | 6/1976 | Bomberger, Jr. et al. | 148/11.5 F |
| 4,053,330 | 10/1977 | Henricks et al. | 148/11.5 F |
| 4,543,132 | 9/1985 | Berczik et al. | 148/11.5 F |
| 4,842,652 | 6/1989 | Smith et al. | 148/12.7 B |
| 4,842,653 | 6/1989 | Wirth et al. | 148/12.7 B |
| 4,854,977 | 8/1989 | Alheritiere et al. | 148/12.7 B |

FOREIGN PATENT DOCUMENTS

| | | | |
|---|---|---|---|
| 0003913 | 1/1985 | Japan | 148/11.5 F |
| 1159563 | 7/1986 | Japan | 148/11.5 F |
| 3045356 | 2/1988 | Japan | 148/11.5 F |
| 3130755 | 6/1988 | Japan | 148/12.7 B |
| 1076490 | 2/1984 | U.S.S.R. | 148/11.5 F |
| 2070055A | 9/1981 | United Kingdom | 148/11.5 F |

*Primary Examiner*—Upendra Roy
*Attorney, Agent, or Firm*—Daniel A. Sullivan, Jr.

[57] ABSTRACT

High performance Ti-6A1-4V alloys skewed with oxygen and nitrogen and useful as impellers are provided and a process for their preparation.

12 Claims, 5 Drawing Sheets

PROCESSING FOR HIGH PERFORMANCE TI-6A1-4V FORGINGS

This application is a division of application Ser. No. 07/203,691, filed June 7, 1988 now U.S. Pat. No. 4,895,624.

TECHNICAL FIELD

This invention relates to titanium alloys having improved mechanical properties rendering them more useful as rotating components such as impellers, disks, shafts and the like for gas turbines and the like.

BACKGROUND OF THE INVENTION

Turbine engine impellers of Ti-6Al-4V are currently being used both by gas turbine engine manufacturing companies in the USA and abroad for use at temperatures of up to 300° C. However, while the low cycle fatigue (LCF) life is generally good, it would be preferable to have better fatigue performance to extend the design life of such rotating components. This invention is directed toward this goal. Other benefits are also obtained, as will become apparent from that which follows.

DISCLOSURE OF INVENTION

It has now been discovered that titanium alloys can be prepared which are suitable for use as impellers and for other uses involving significantly improved low cycle fatigue life and tensile properties while maintaining good fracture toughness.

More particularly, it has been discovered that combining choice of a Ti-6Al-4V alloy of composition skewed toward higher oxygen and nitrogen contents with appropriate fabrication and heat treatment procedures develops a particularly improved microstructure permitting manufacture of improved components.

BRIEF DESCRIPTION OF DRAWINGS

The drawings are photomicrographs of a Ti-6Al-4V alloy skewed composition

FIG. 1 depicts a microstructure of 3.0 in. dia. (top) and 5.0 in. dia. billet stock (bottom) showing elongated primary alpha in an aged beta matrix.

MODES FOR CARRYING OUT THE INVENTION

The Ti-6Al-4V alloys which can be used to obtain the improved properties have the following general composition:

5.5 to 6.75% Al,
3.5 to 4.5% V,
0.15 to 0.2% O,
0.025 to 0.05% N,
≦0.3% Fe,
0 to ≦0.08% C,
0 to ≦0.0125% H,
0 to <0.005 Y,
residual elements each 0 to <0.1%, total 0 to <0.4%, and the remainder Ti. It should be noted that the amounts of O and N are at, i.e., skewed toward, the high end of the range permitted by AMS (Aerospace Material Specification)-4920 and 4965D for Ti-6Al-4V, as published by the Society of Automotive Engineers, Warrendale, Pa. This is intentional and is partly responsible for the beneficial result.

Figure 5:
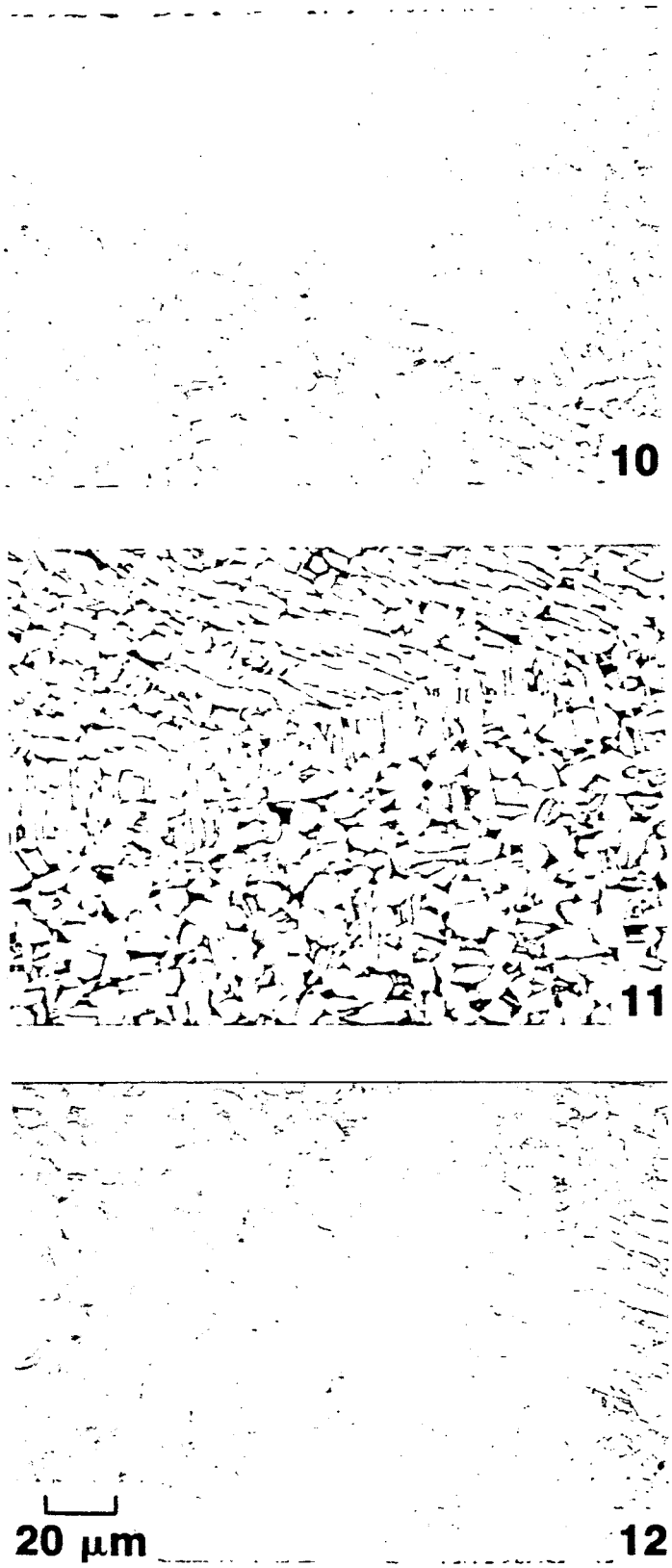
FIG. 5 depicts optical photomicrographs of the pancake forgings, at the mid-radius mid-height location, processed through process conditions Nos. 1? (top), 11 (middle) and 12 (bottom) showing nearly equiaxed primary alpha, platelets of secondary alpha in an aged beta matrix.

Further, the microstructure of the improved alloys comprises primary alpha particles with plateleta of secondary alpha in an aged beta matrix. This is best illustrated by the result of a preferred processing sequence, #11, as shown in FIG. 5, where the round white regions are primary alpha, the layered white regions are secondary alpha, and the dark phase is aged beta matrix.

Figure 1:
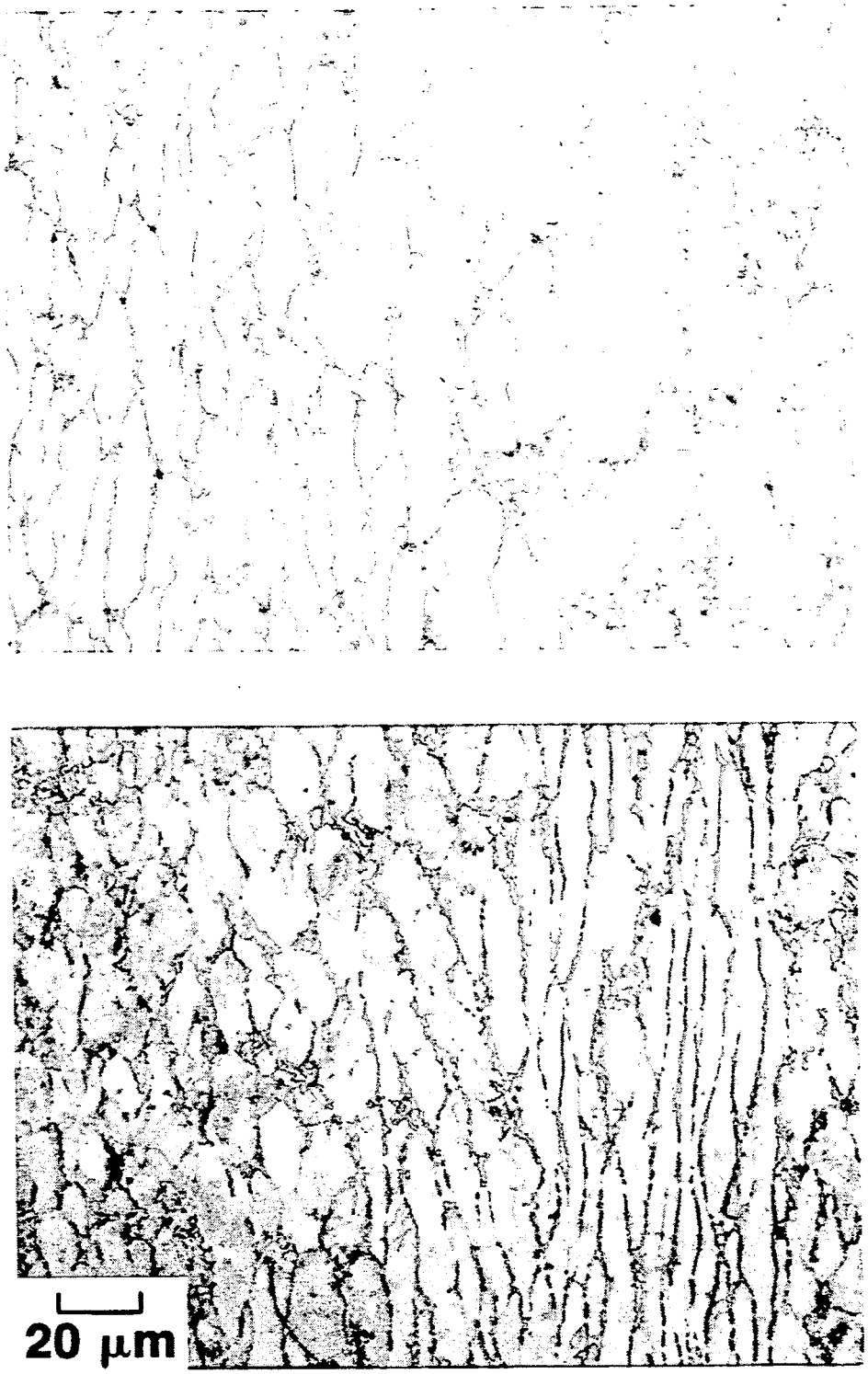
FIG. 1 shows the bar stock in condition as received from the mill (forged and annealed at 705° C. for 2 hours), while FIGS. 2–5 result from the process conditions listed in Table II. The number in the lower right corner of each photo in FIGS. 2–5 is the Example Number reported in Tables II and III.
Figure 2:
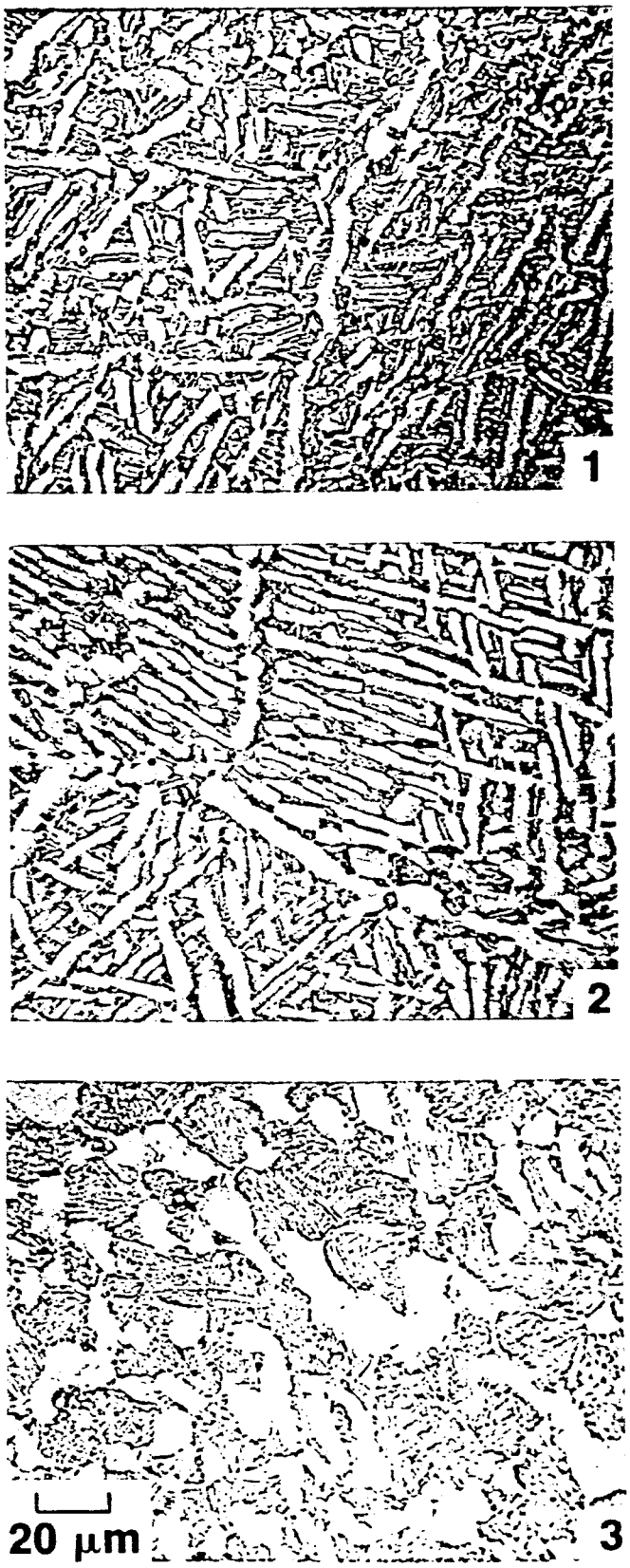
FIG. 2 depicts optical photomicrographs of the pancake forgings, at the mid-radius mid-height location, processed through process conditions Nos. 1 (top), 2 (middle) and 3 (bottom) showing primary and secondary alpha in an aged beta matrix.
Figure 3:
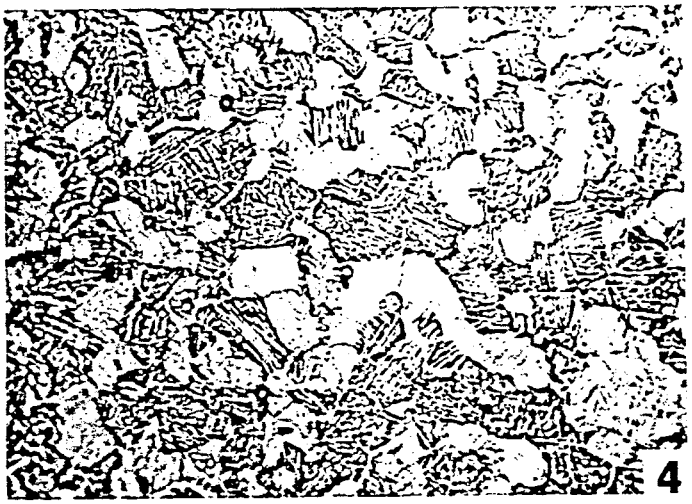
FIG. 3 depicts optical photomicrographs of the pancake forgings, at the mid-radius mid-height location, processed through process conditions Nos. 4 (top), 5 (middle) and 6 (bottom) showing primary alpha and secondary alpha in an aged beta matrix.
Figure 3:
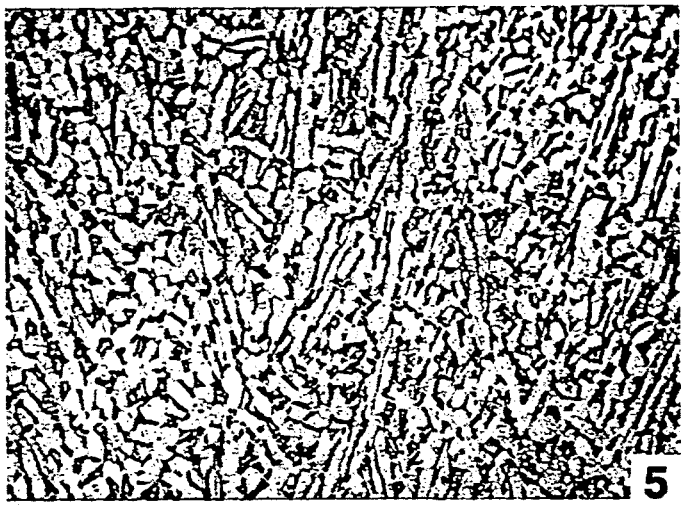
Figure 3:
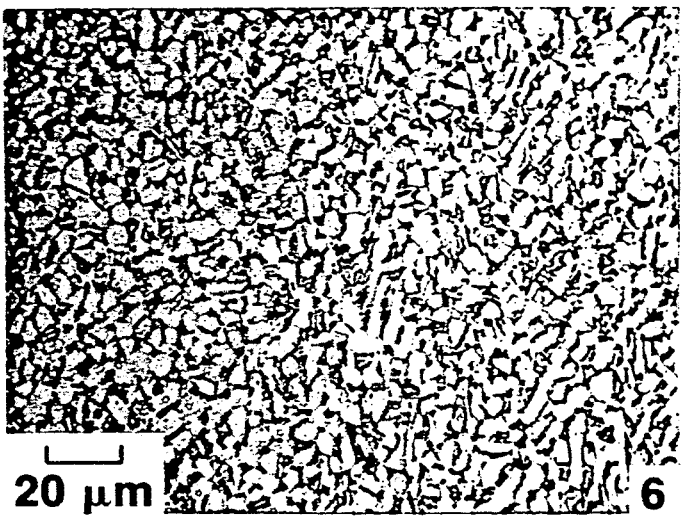
Figure 4:
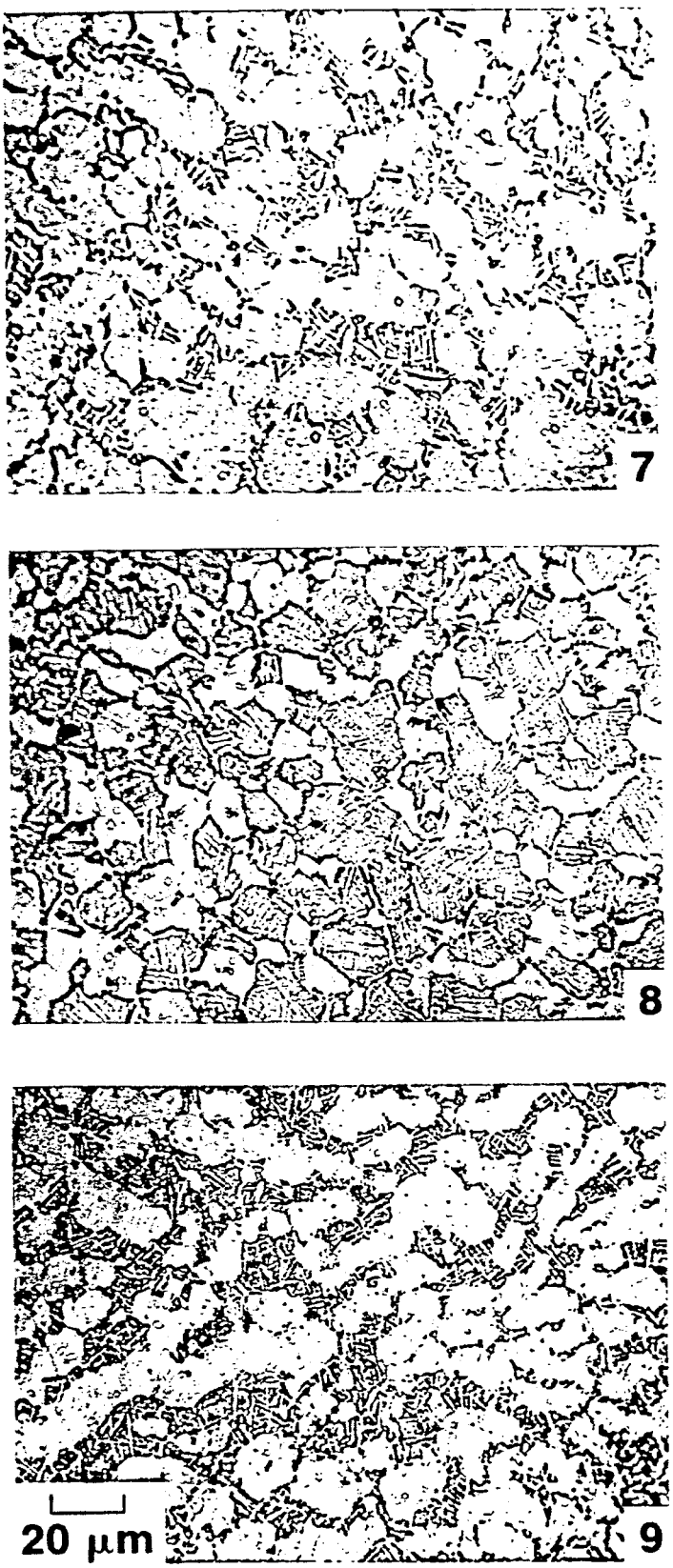
FIG. 4 depicts optical photomicrographs of the pancake forgings, at the mid-radius mid-height location, processed through process conditions Nos.7 (top), 8 (middle) and 9 (bottom) showing equiaxed alpha in an aged transformed beta type matrix.

To obtain the desired microstructure, billet as in FIG. 1 is pre-heated above the beta-transus for a sufficient time and temperature followed by fast cooling to obtain a fine transformed beta structure (FIG. 2*b* in G. Lutjering and A. Gysler (Fatigue-Critical Review), *Titanium Science and Technology,* edited by G. Lutjering, U. Zwicker and W. Bunk, Proceedings of the Fifth International Conference on Titanium, Munich, FRG, 1984 Sep. 10–14, p. 2067). The beta-transus occurs at about 1825° F. for this alloy. It has been found that a temperature between about 40° and 70° F. above the beta-transus should be employed for about 20 minutes followed by rapid cooling in an oil or water quench (depending on the stock size). This pre-forging treatment causes the formation of between about 60 and about 90% by volume transformed beta platelets and achieves the desired platelet thickness of between about 2 μm and about 10 μm.

The fine transformed beta structure is then pre-heated within a temperature range of 1500° to 1750° F. (below the beta-transus) for about 20 minutes to an hour, depending on section size, to provide a uniform temperature throughout the billet. The minimum time to accomplish this is chosen, since excessive time leads to coarsening of the transformed beta platelets, an undesired phenomenon. Temperatures toward the 1500° F. end of this range lead to finer primary alpha structure after subsequent heat treatment, this being preferred, and thus a most preferred temperature range is between about 1500° and about 1575° F.

The billet is then removed from the furnace and hot-die forged preferably at a temperature between about 1525° and about 1575° F. until a reduction ratio of ≧3:1 is achieved. The forging is subsequently cooled such as by oil quenching or water quenching (depending on section size).

To create a desirable microstructure in this alloy, a solution treatment for instance at a temperature 55 to 85° F. below the beta-transus for about ½ hour to 1 hour (depending on section size) followed by cooling such as in air, oil or water, is employed. The cooling medium is chosen as a function of section size to obtain a cooling rate yielding a desired high toughness. Compare Example 11 versus Example 6. Following solution treatment and cooling, primary alpha and secondary alpha are formed.

The alloy is then preferably aged to precipitate some fine alpha and perhaps to grow the primary alpha and the secondary alpha somewhat. The aging treatment strengthens the alloy and stabilizes the microstructure. Two basic types of aging were employed, a two-step process and a one-step process. In the two-step process, the alloy is first aged in the temperature range 1275° to about 1525° F. for about 1 hour followed by oil or water quenching plus 915° to 950° F. for 8 to 24 hours followed by air cooling. The single step aging is at about 1275° to 1325° F. for about 2 hours followed by air cooling.

Typical forgings prepared by the above procedure will have a yield strength (0.2% offset) above about 140 ksi, an ultimate tensile strength above about 145 ksi, a percent elongation of at least about 12, a reduction in area of greater than 25%, and a fracture toughness ($K_{Ic}$) of at least about 45 ksi $\sqrt{in}$ (illustrated in Table III, Example Nos. 11 and 12), and a low cycle fatigue of >15,000 cycles (Nf) at the maximum load of 127.7 ksi.

The following examples will serve to illustrate the invention. All parts and percentages are by weight unless otherwise indicated, as is the case elsewhere in the specification and claims.

EXAMPLE

In the following Table I the ingredients and amounts are given for the alloy tested.

TABLE I

Chemical Analysis of Ti-6Al-4V Forging Bar Stock

| Billet No. | Dimensions | C | N | Fe | Al | V | O | H | Y |
|---|---|---|---|---|---|---|---|---|---|
| 1 | 7.6 cm dia. | .04 | .036 | .23 | 6.1 | 4.1 | .187 | 61 ppm | <50 ppm |
| 2 | 12.7 cm dia. | .04 | .036 | .23 | 6.1 | 4.1 | .182 | 53 ppm | <50 ppm |
| AMS-4920 Specification | | 0.1* | 0.05* | 0.3* | 5.5/ 6.75 | 3.5/ 4.5 | 0.2* | 125 ppm | <50 ppm |

NOTE:
*designates the maximum allowed in the Specification.

In the following Table II, 12 different processing conditions are shown by which forging were made.

TABLE II

Phase I-Processing Methods
Stock: 3.0 in. × 3.0 in. Length Forge Size: 5.0 in. × 1.0 in. (thick) = 3:1 Forging Reduction

| Ex. No. | Prior Stock Treatment | Forging Condition: Stock Temp. (°F.) | Forging Condition: Die Temp. (°F.) | Post-Forge Cooling | Heat Treatments: Solution | Heat Treatments: Anneal | Heat Treatments: Age |
|---|---|---|---|---|---|---|---|
| 1 | Beta Soln., OQ | 1750° F./½ hr | 1700 | Press OQ | 1780° F./½ hr, OQ | 1475° F./1 hr, OQ | 932° F./24 hr, AC |
| 2 | Beat Soln., OQ | 1750° F./½ hr | 1700 | Press OQ | 1750° F./½ hr, OQ | 1475° F./1 hr, OQ | 932° F./24 hr, AC |
| 3 | AR | 1750° F./½ hr | 1700 | Press OQ | 1780° F./½ hr, OQ | 1475° F./1 hr, OQ | 932° F./24 hr, AC |
| 4 | AR | 1750° F./½ hr | 1700 | Press OQ | 1750° F./½ hr, OQ | 1475° F./1 hr, OQ | 932° F./24 hr, AC |
| 5 | Beta Soln., OQ | 1675° F./½ hr | 1675 | Press OQ | 1750° F./½ hr, OQ | 1475° F./1 hr, OQ | 932° F./24 hr, AC |
| 6 | Beta Soln., OQ | 1600° F./½ hr | 1675 | Press OQ | 1750° F./½ hr, OQ | 1475° F./1 hr, OQ | 932° F./24 hr, AC |
| 7 | AR | 1675° F./½ hr | 1675 | Press OQ | — | 1475° F./3, FAC @ 150° F./1 hr to 1112° F., AC | — |
| 8 | AR | 1675° F./½ hr | 1675 | AC | 1770° F./½ hr, OQ | — | 1300° F./2 hr, AC |
| 9 | AR | 1675° F./½ hr | 1675 | Press OQ | — | 1475° F./1 hr, OQ | 932° F./24 hr, AC |
| 10 | Beta Soln., OQ | 1600° F./½ hr | 1600 | Press OQ | 1790° F./½ hr, FAC | 1475° F./1 hr, OQ | 932° F./24 hr, AC |
| 11 | Beta Soln., OQ | 1550° F./½ hr | 1600 | Press OQ | 1790° F./½ hr, FAC | 1475° F./1 hr, OQ | 934° F./24 hr, AC |
| 12 | Beta Soln., OQ | 1550° F./½ hr | 1600 | Press OQ | 1790° F./½ hr, FAC | — | 1300° F./2 hr, AC |

Beta Soln. = Heat treatment of 40–75° F. above beta-transus for 20 minutes. OQ = oil quench, AR = as received, AC = air cool, FAC = fan air cool, Press OQ = directly oil quenched from the forging press In Tables III and IV, the mechanical properties are given for each of the examples in Table II. In Table V, the data is given for two specimens for each of Examples 6–12.

TABLE III

Room Temperature Tensile Properties and Fracture Toughness of the Phase I Ti-6Al-4V Pancake Forgings

| Example No. | Tensile Properties: YS (ksi) | Tensile Properties: UTS (ksi) | Tensile Properties: % El | Tensile Properties: % RA | Fracture Toughness $K_{Ic}$ ksi $\sqrt{in.}$ |
|---|---|---|---|---|---|
| 1 | 157.0 | 160.5 | 16.5 | 34.0 | Not Tested |
| 2 | 157.5 | 161.5 | 15.5 | 35.3 | Not Tested |
| 3 | 153.0 | 158.3 | 15.0 | 36.3 | Not Tested |
| 4 | 154.2 | 159.2 | 15.0 | 34.5 | 34.9 |
| 5 | 160.7 | 162.0 | 16.0 | 37.0 | 36.6 |
| 6 | 157.5 | 158.5 | 14.5 | 34.0 | 36.0 |
| 7 | 149.5 | 151.2 | 16.0 | 36.5 | 36.6 |
| 8 | 150.5 | 155.3 | 15.5 | 39.5 | 37.0 |
| 9 | 161.5 | 163.3 | 14.0 | 30.6 | 30.3 |
| 10 | 157.8 | 163.3 | 15.0 | 41.3 | 44.6 |
| 11 | 157.7 | 163.0 | 16.0 | 42.2 | 48.1 |
| 12 | 141.6 | 148.6 | 17.0 | 41.3 | 48.6 |

YS = yield strength, UTS = ultimate tensile strength, El = elongation, and RA = reduction in area. The alloys were tested by ASTM E 8-83 (room temperature tension tests) and ASTM E 399-83 (fracture toughness test).

TABLE IV

300° C. (572° F.)-Tensile Properties of Ti-6Al-4V
5.0 in. Diameter × 1.0 in. Thick Pancake Forgings

| Example No. | Tensile Properties YS (ksi) | UTS (ksi) | % El | % RA |
|---|---|---|---|---|
| 1 | Not Tested | | — | — |
| 2 | Not Tested | | — | — |
| 3 | Not Tested | | — | — |
| 4 | 102.4 | 121.0 | 17.0 | 52.0 |
| 5 | 99.6 | 117.7 | 19.0 | 53.9 |
| 6 | 100.8 | 118.5 | 19.0 | 58.4 |
| 7 | 94.7 | 111.5 | 19.0 | 55.8 |
| 8 | 95.2 | 114.5 | 18.0 | 53.9 |
| 9 | 107.0 | 123.3 | 18.0 | 63.9 |
| 10 | 92.0 | 111.4 | 21.0 | 48.5 |
| 11 | 93.8 | 113.7 | 19.0 | 51.3 |
| 12 | 83.0 | 103.0 | 21.0 | 50.3 |
| Goal | 84.0 | 100.0 | 9.0 | |

The alloys were tested by ASTM E 21-79.

TABLE V

Low Cycle Fatique Data
Load Control with Extensometry
Test Temperature: Room Temperature (78° F.)
Waveform = triangular; 20 CPM
Kt = 1.0 (Smooth Bar Specimen)
Specimen Design: DL-241A (0.25 in. diameter gauge section)

| Example | Stress Ratio "A" | Max. Stress ksi | Min. Stress ksi | Ni Cycles | Nf Cycles | Remarks |
|---|---|---|---|---|---|---|
| 6-1 | 0.905 | 127.7 | 6.4 | 21,752 | 22,612 | FU |
| 6-2 | 0.905 | 127.7 | 6.4 | 0 | 17,394 | FT |
| 7-1 | 0.905 | 127.7 | 6.4 | 20,608 | 22,287 | FU |
| 7-2 | 0.905 | 127.7 | 6.4 | 16,274 | 19,274 | FU |
| 8-1 | 0.905 | 127.7 | 6.4 | 20,785 | 22,325 | FU |
| 8-2 | 0.905 | 127.7 | 6.4 | 18,278 | 18,808 | FU |
| 9-1 | 0.905 | 127.7 | 6.4 | 13,659 | 13,934 | FG |
| 9-2 | 0.905 | 127.7 | 6.4 | 16,625 | 16,769 | FG |
| 10-1 | 0.905 | 127.7 | 6.4 | 15,778 | 16,478 | FI |
| 10-2 | 0.905 | 127.7 | 6.4 | 14,514 | 14,664 | FG |
| 11-1 | 0.905 | 127.7 | 6.4 | 0 | 32,581 | R |
| 11-2 | 0.905 | 127.7 | 6.4 | 17,420 | 17,960 | FI |
| 12-1 | 0.905 | 127.7 | 6.4 | 13,809 | 15,379 | FG |
| 12-2 | 0.905 | 127.7 | 6.4 | 22,359 | 22,909 | FG |

All failures resulted from crack initiation at the surface of the specimen. (FU) failed in uniform section. (FT) failed in threads. (FG) failed in gage. (FI) failed at interface of radius and uniform section. (R) runout and (0) indicates the information is not available. The alloys were tested by ASTM E 606-80 (low cycle fatigue).

From the data reported in Tables III, IV and V, it can be seen that the alloys of the invention have excellent low cycle fatigue performance and fracture toughness. Particularly effective are Examples 10–12.

While the invention has been illustrated by numerous examples, obvious variations may occur to one of ordinary skill and thus the invention is intended to be limited only by the appended claims.

What is claimed is:

1. A process for preparing forgings of improved properties comprising treating an alloy feed stock having a majority of alpha particles and a composition comprising 5.5 to 6.75% Al,
3.5 to 4.5% V,
0.1 to 0.2% O,
0.02 to 0.05% N,
≦0.3% Fe,
0 to ≦0.08% C,
0 to ≦0.0125% H,
0 to ≦0.005 Y,
residual elements each 0 to ≦0.1%
total 0 to ≦0.4%, and the remainder Ti, the treating comprising (a) heating said feed stock at a temperature between about 40° and 70° F. above the beta-transus for a time sufficient to form 100% beta phase, followed by a rapid cooling to form between about 60% and about 90% transformed beta platelets by volume and achieve the desired platelet thickness of between 2 um to 10 um, (b) heating the resultant fine transformed beta structure billet at a temperature between about 1500° and 1750° F. or below the beta-transus for a time, sufficient to provide a uniform temperature throughout the billet, (c) forging the resultant billet for a time and temperature sufficient to obtain a reduction ratio of ≧about 3:1, and (d) cooling the forged material and solution treating at a temperature and time sufficient to form primary alpha particles followed by cooling and aging the resultant alloy.

2. The process of claim 1 wherein the heating in (a) is for at least about 20 minutes.

3. The process of claim 1 wherein the heating in (b) is from about 20 minutes to about 60 minutes.

4. The process of claim 1 wherein the heating in (b) is conducted at a temperature between about 1500° and about 1575° F.

5. The process of claim 1 wherein the forging of (c) is conducted at a temperature between about 1525° and about 1575° F.

6. The process of claim 1 wherein the solution treatment of (d) is conducted at a temperature of between about 55° and 85° F. below the beta-transus.

7. The process of claim 1 wherein the solution treatment of (d) is conducted at a temperature about 55° to 85° F. below the beta-transus for about 30 minutes.

8. The process of claim 1 wherein the aging of (d) comprises heating at a temperature between about 1275° and about 1525° F. followed by quenching.

9. The process of claim 1 wherein the aging of (d) comprises heating at a temperature between about 1275° and about 1325° F.

10. The process of claim 8 wherein the alloy is aged for about 1 hour.

11. The process of claim 8 wherein the aging comprises an additional heat treatment at a temperature between about 915° and about 950° F. for about 8 to about 24 hours, followed by cooling.

12. The process of claim 9 wherein the heating is conducted for about 2 hours.

* * * * *

UNITED STATES PATENT AND TRADEMARK OFFICE

CERTIFICATE OF CORRECTION

PATENT NO. : 5,118,363

DATED : June 2, 1992

INVENTOR(S) : Chakrabarti et al

It is certified that error appears in the above-indentified patent and that said Letters Patent is hereby corrected as shown below:

| | |
|---|---|
| Col. 1, line 42 | After "alloy" insert --of--. |
| Col. 1, line 42 | After "composition" insert a period. |
| Col. 1, line 68 | Delete "?" and insert --0--. |
| Col. 2, line 17 | Change "<" to --≤--. |
| Col. 2, line 18 | Change "<", both occurrences, to --≤--. |
| Col. 6, line 20 | Delete "," at the end of the line after "time". |

Signed and Sealed this

Third Day of August, 1993

*Attest:*

*Attesting Officer*

Michael K. Kirk

MICHAEL K. KIRK

*Acting Commissioner of Patents and Trademarks*